US007721724B2

(12) United States Patent
Goade

(10) Patent No.: US 7,721,724 B2
(45) **Date of Patent: *May 25, 2010**

(54) SHOCK SUPPRESSOR FOR A BOW

(76) Inventor: Joseph Daniel Goade, 2892 Highway 51 South, Dyersburg, TN (US) 38024

( * ) Notice: Subject to any disclaimer, the term of this patent is extended or adjusted under 35 U.S.C. 154(b) by 0 days.

This patent is subject to a terminal disclaimer.

(21) Appl. No.: 11/147,572

(22) Filed: Jun. 8, 2005

(65) Prior Publication Data

US 2006/0278207 A1 Dec. 14, 2006

(51) Int. Cl.
*F41B 5/20* (2006.01)

(52) U.S. Cl. ..... 124/89; 124/25.6

(58) Field of Classification Search ..... 124/89, 124/86, 25.6; 16/86 R, 86 A, 86 B, 86 C; 267/139, 140, 153
See application file for complete search history.

(56) References Cited

U.S. PATENT DOCUMENTS 1,044,412 A * 11/1912 Newton ..... 16/85
1,211,480 A * 1/1917 Newton ..... 16/85
1,232,000 A * 7/1917 Chase ..... 16/85
1,354,469 A * 10/1920 Joseph ..... 16/86 A
1,918,652 A * 7/1933 Marbach ..... 16/82
4,054,121 A * 10/1977 Hoyt, Jr. ..... 124/89
4,061,125 A * 12/1977 Trotter ..... 124/23.1
4,461,267 A * 7/1984 Simonds et al. ..... 124/25.6
5,010,622 A * 4/1991 Morita ..... 16/85
5,178,122 A * 1/1993 Simonds ..... 124/25.6
5,320,085 A * 6/1994 Hanneman ..... 124/89
5,392,757 A * 2/1995 Head et al. ..... 124/86
5,452,704 A * 9/1995 Winebarger ..... 124/92
5,531,211 A * 7/1996 Wilfong, Jr. ..... 124/86
5,535,731 A * 7/1996 Webster ..... 124/89
5,649,527 A * 7/1997 Olsen et al. ..... 124/89
5,720,269 A * 2/1998 Saunders ..... 124/86
5,992,403 A * 11/1999 Slates ..... 124/89
6,092,516 A * 7/2000 Martin et al. ..... 124/88
6,298,842 B1 * 10/2001 Sims ..... 124/89
6,634,348 B2 * 10/2003 Gallops, Jr. ..... 124/25.6
6,745,757 B2 * 6/2004 Sims ..... 124/89

OTHER PUBLICATIONS

Bow Master Magazine, Grand View Media Group, Summer 2004 edition , Apr. 4, 2004 at pp. 28 and 70. In color.
Comments posted at www.archerytalk.com.

* cited by examiner

*Primary Examiner*—John Ricci
(74) *Attorney, Agent, or Firm*—Defilló & Associates, Inc; Evelyn A. Defilló

(57) ABSTRACT

The present invention relates to a suppressor having: a rod having a first end and a second end; a mounting block having at least two bore holes, wherein the rod passes through one of the bore holes, wherein a fastener passes through the other bore hole; a cushion located at the first end of the rod, the cushion having a first face and a second face; and wherein the cushion includes at least one slot at the first face and a treaded portion at the second face. The shock suppressor is mounted to the riser of an archery bow.

12 Claims, 5 Drawing Sheets

SHOCK SUPPRESSOR FOR A BOW

TECHNICAL FIELD

The present invention relates to archery bows, and particularly to a device for stopping the vibration and sound generated in the process of drawing and releasing the bow string.

DESCRIPTION OF THE RELATED PRIOR ART

Archery and bow hunting have become increasingly popular sports. This popularity has spawned increasingly sophisticated bows, arrows, and bow accessories.

In the sport of archery, the basic configuration and operation of compound bows are generally known as they have been in use for a long time. Compound bows are used a great deal in hunting, because they provide several distinct advantages. Compound bows mechanically reduce the maximum draw weight, allowing the archer to hold full draw at a draw weight, less than that of the required maximum.

Compound bows also achieve more gradual arrow acceleration upon release with reduced stress on the arrow and the archer, which increases the arrow speed and shooting accuracy.

Compound bows include tension cables and a bowstring, which are connected between the upper and lower bow limbs. It is customary, in order to minimize any twisting torque on the bow limbs, to dispose the bowstring and the tension cables relatively close together, proximate the vertical centerline of the bow.

A drawback of the compound bow is the vibration generated upon releasing the bowstring to propel the arrow. When the bowstring reaches the end of its arrow-propelling path, the cables are propelled forwardly causing considerable hand shock. The portion of the cables which cross in the middle portion of the bow rub against each other to produce noise wasting kinetic energy. If used while hunting, the noise may alert game birds and animals.

Furthermore, the vibration generated when an arrow is launched from the bow gives a strange feeling to the holder of the bow when the arrow is launched. In addition, the vibration has a harmful effect upon the arrow flight.

These problems are apparent in both traditional bows and in compound bows, though it is more pronounced in compound bows since the amount of energy transferred is greater.

Numerous solutions to the above problems have been proposed over the years and the conventional approach to the problem has been to attach a device to the string above the knocking point for the arrow. U.S. Pat. No. 3,837,327 to Saunders et al. shows one of the proposed solutions to this problem.

Other prior art solutions have been to attach a plurality of short pieces of yarn and/or tying a bundle of short and narrow strips of flexible rubber to the string. While these prior art solutions have reduced the noise from bows to a great degree, the problem of deer or other game "jumping the string" as described above is still a problem because the noise has not been eliminated sufficiently.

Since a significant portion of this vibration is generated by the action of the limbs of the archery bow, means have been developed which mount onto the limbs themselves, which absorb or reduce the amount of vibration. However, these means for absorbing the vibration from the limbs have certain disadvantages. In particular, such means are attached to the limbs by an adhesive. This adhesive is subject to failure with the result that the vibration absorbing means will be thrown off of the limb. If this should occur, this has a very deleterious effect upon the performance of the bow and may result in a broken limb.

However, the major problem with these prior art solutions resides in the fact that attachment of any materials to the bowstring will affect the path and speed of the bowstring, thereby creating an effect on the archer's shot.

Another problem with these prior art solutions resides in the fact that the attachment construction and positioning on the bowstring, while dampening vibration and reducing noise, does tend towards reducing the speed of the arrow.

The arrow speed depends upon several factors, one of the most important being the amount of energy put into the bow. Generally speaking, the more total energy put into the bow, the faster that the arrow will be propelled. Increased arrow speed is desirable, especially when hunting and shooting heavy arrows.

There exists an apparent need for an effective device for dampening vibration and reducing shock specifically in an archery bow, and, at the same time, increases the arrow speed.

SUMMARY OF THE INVENTION

It is an object of this invention to provide a shock suppressor for an archery bow that reduces the hand shock.

It is another object of the present invention to provide a shock suppressor for an archery bow that is simple and less susceptible to wear and tear.

It is yet another object of the present invention to provide a shock suppressor that decreases the noise generated during the use as to not alert or frighten game birds and animals.

It is yet another object of the present invention to provide a shock suppressor, which is economical to produce and maintain.

It is yet another object of the present invention to provide a shock suppressor, which can easily be installed upon a compound bow and/or re-curve bow.

It is yet another object of the present invention to provide a shock suppressor, which is compatible with left and right hand bows.

It is yet another object of the present invention to provide a shock suppressor, which eliminates the need for an armguard by removing the oscillations of the string, which in turn would normally strike the archers bow arm and/or wrist.

It is yet another object of the present invention to provide a shock suppressor, which makes any bow more forgiving/accurate by launching the arrow at the brace height of the bow instead of the arrow riding the string inside the brace height of the bow toward the riser, before the arrow disengages the bow string.

The present invention relates to shock suppressor for a compound bow, and more particularly, to shock suppressor that reduces noise and vibrations.

The shock suppressor comprising:

a rod having a first end and a second end;

a mounting block having at least two bore holes, wherein the rod passes through one of the bore holes, wherein a fastening means passes through the other bore hole;

a cushion located at the first end of the rod.

The present invention also contemplates a shock suppressor for use with a compound bow, the compound bow having a riser and a pair of opposite bow limbs, a first and a second cable, which cross one another in extending between opposite bow limbs, a bowstring, an opening for a stabilizer, the shock suppressor comprising:

a rod having a first end and a second end;

a mounting block having at least two bore holes, wherein the first end of the rod passes thru one of the bore holes, wherein a fastening means passes thru the other bore hole;

a cushion attached to the second end of the rod;

wherein the fastening means is attached to the opening of the stabilizer;

wherein the shock suppressor is mounted into the riser below a knocking point.

The foregoing has outlined some of the more pertinent objects of the present invention. These objects should be construed to be merely illustrative of some of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

BRIEF DESCRIPTION OF THE FIGURES

For a fuller understanding of the nature and objects of the invention, reference should be made to the following detailed description taken in connection with the accompanying drawings in which.

DETAIL DESCRIPTION OF THE INVENTION

Figure 1:
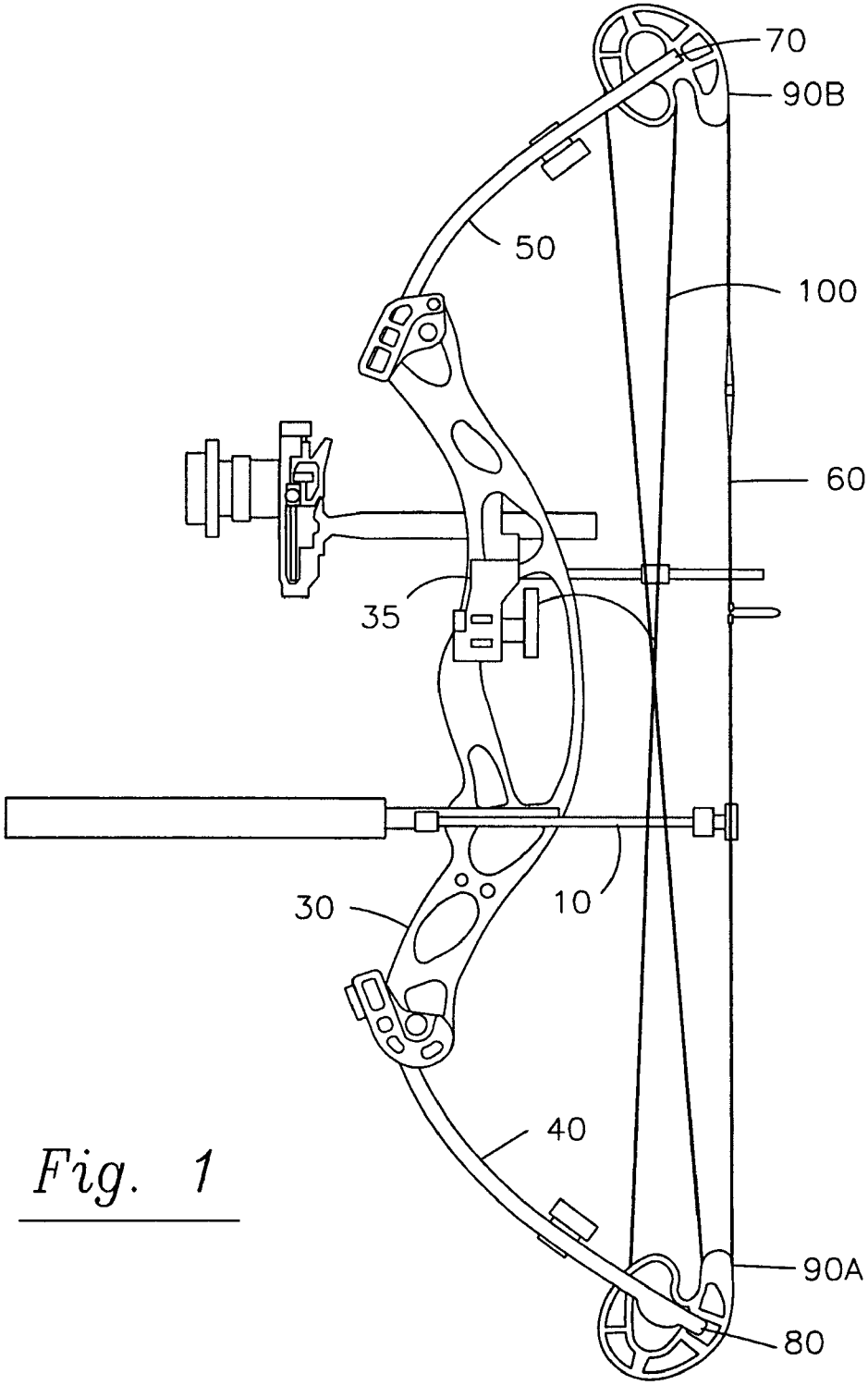
FIG. 1 is a side view, illustrating the shock suppressor of the present invention attached to a compound bow in a rest position.

FIG. 1 is a side view, illustrating the shock suppressor 10 of the present invention attached to a compound bow 20 in a rest position. The shock suppressor 10 is used with a conventional compound bow 20 having a bow handle 30, a riser 35, and a pair of bow limbs 40, 50. The first bow limb 40 and the second bow limb 50 are oppositely positioned in bow riser. Bowstring 60 spans between a first bow tip 70 and a second bow tip 80. The bowstring 60 then continues and extends over the pulleys, wheels and/or cams 90A, 90B positioned at or proximate to each of the bow tips 70, 80, and then the two ends of the bowstring 60, designated first cable end 100 and second cable end 110, cross to the opposite limb at which point they are attached to define a compound bow 20.

Figure 2:
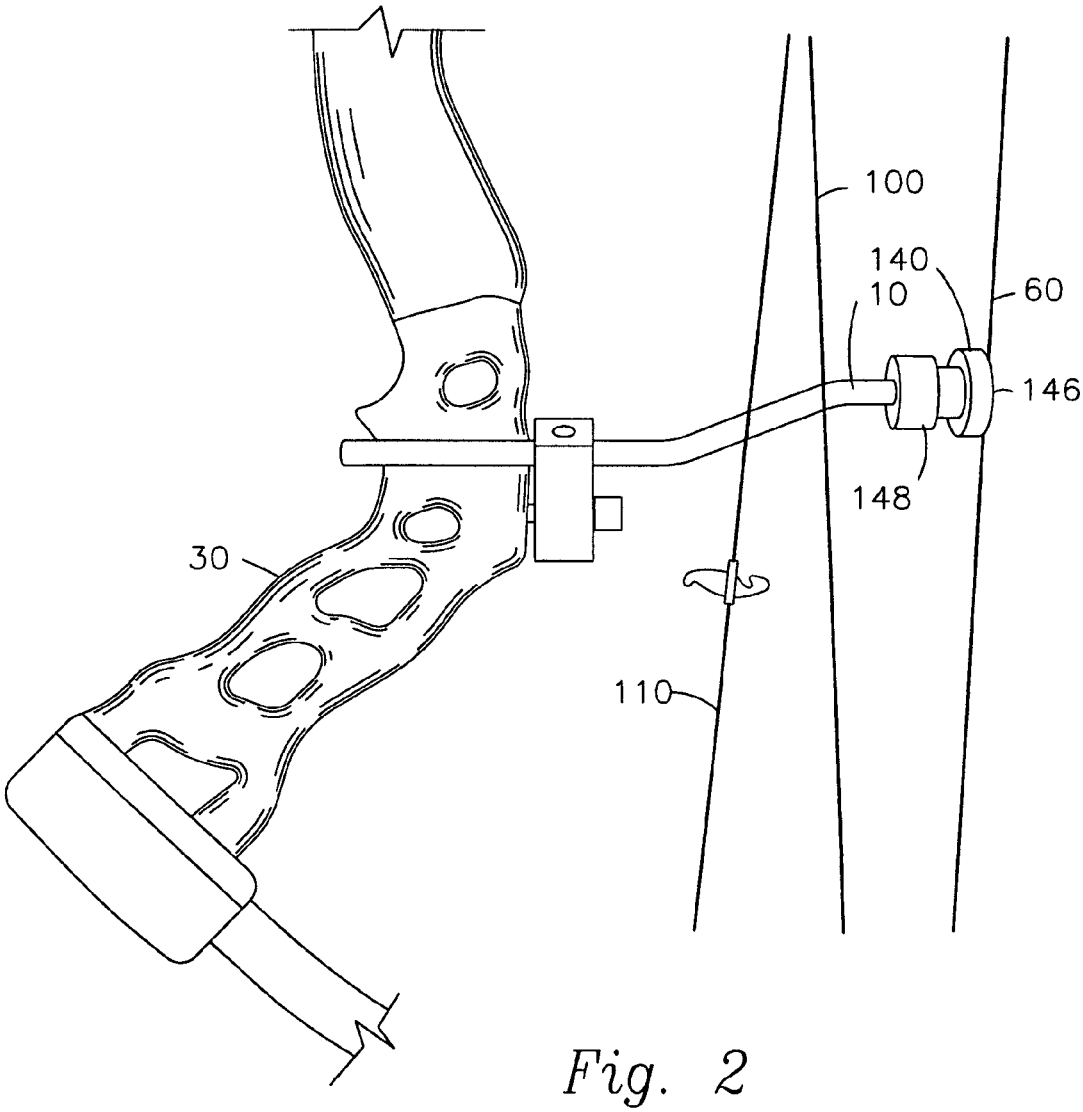
FIG. 2 is a closer view of the shock suppressor according to FIG. 1, showing in detail the shock suppressor.

FIG. 2 shows a magnified view of the shock suppressor according to FIG. 1, showing in detail the shock suppressor 10.

Figure 3:
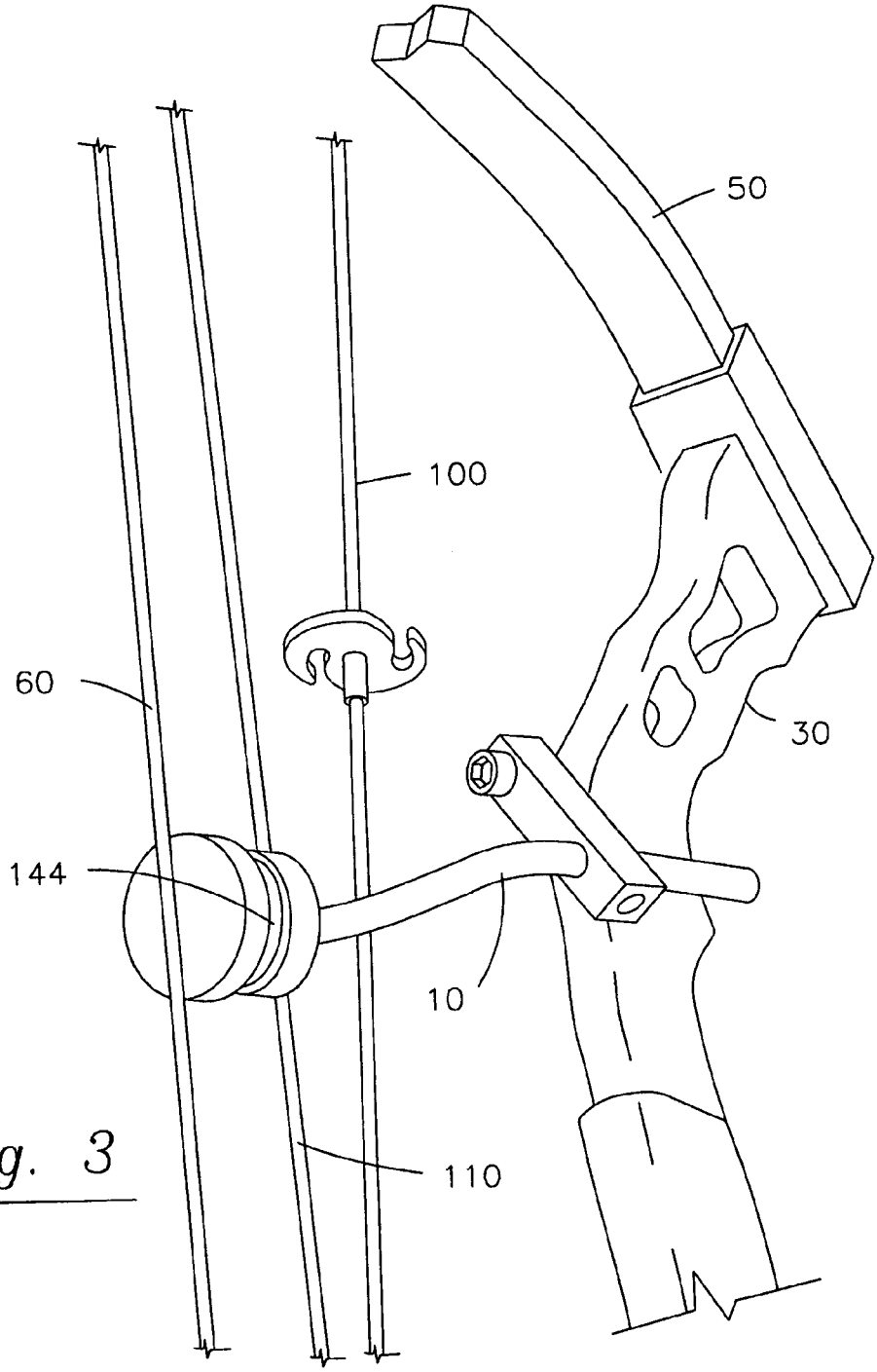
FIG. 3 is a left side view of the shock suppressor according to FIG. 2.

FIG. 3 is a left side view of the shock suppressor according to FIG. 2.

Figure 4:
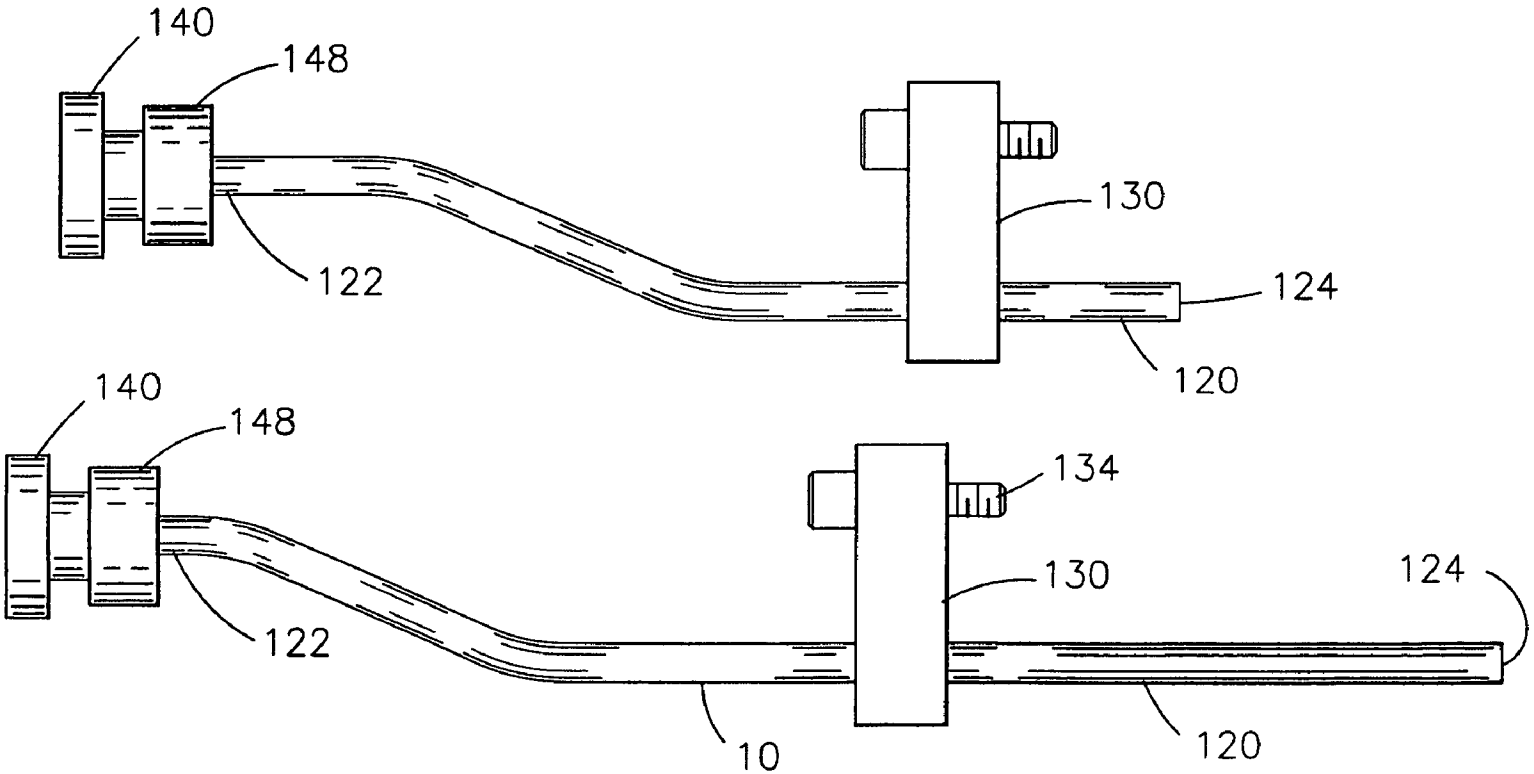
FIG. 4 is a side view of the shock suppressor according to the present invention in the assembly position.
Figure 5:
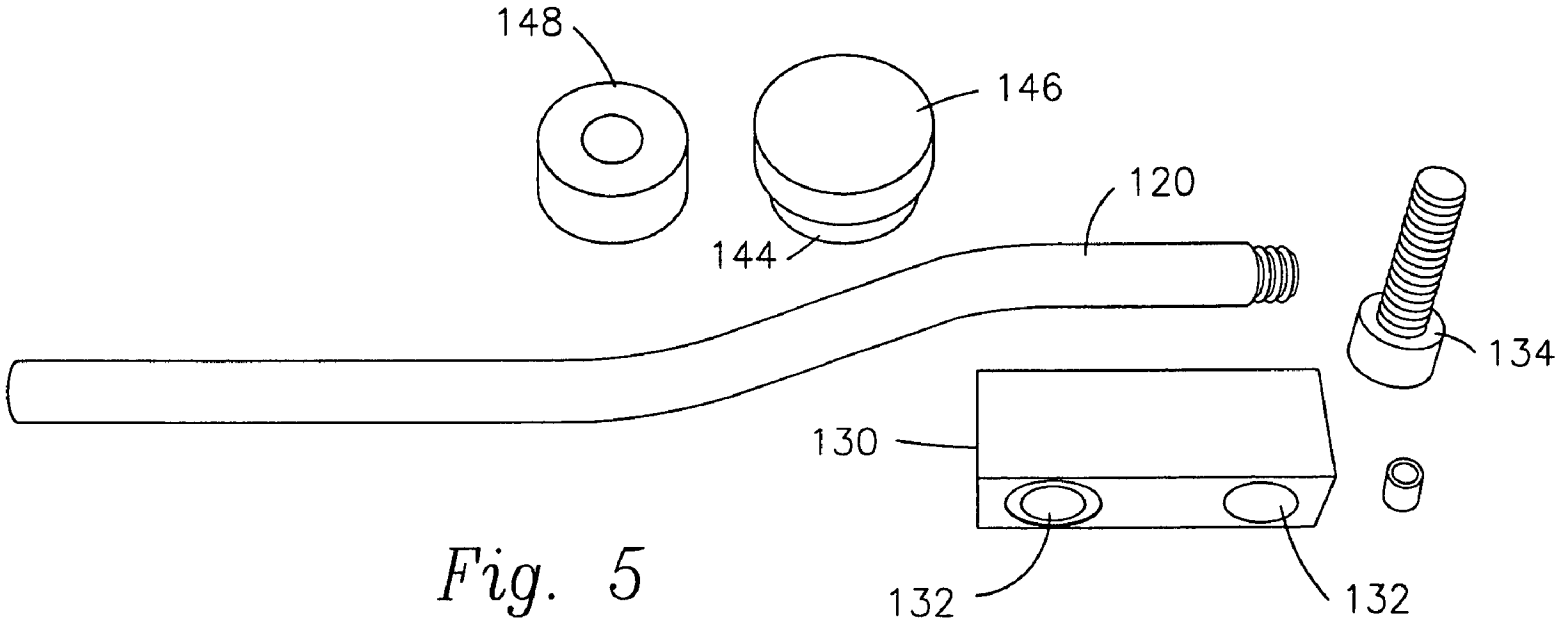
FIG. 5 is a perspective view of the disassembled parts of the shock suppressor of the present invention in a disassembling position.

FIG. 4 shows the details of the shock suppressor according to the present invention.

The shock suppressor 10 comprises:

a rod 120 having a first end 122 and a second end 124;

a mounting block 130 having at least two bore holes 132, wherein the rod passes thru one of the bore holes, wherein a fastening means 134 passes thru the other bore hole;

a cushion 140 located at the first end of the rod 120.

Rod

The rod 120 is a made of a rigid material such as aluminum plastic, steel, titanium, composite material, such as fiberglass, carbon composite, or carbon laminate.

The length of the rod is between 5 to 15 inches, preferably 11.5 inches.

In a preferable embodiment, the rod has an offset bend shape.

Mounting Block

The mounting block 130 is a made of a rigid material, such as—aluminum, steel, titanium, fiberglass, carbon composite, or carbon laminate.

The mounting block can be of any desirable size. In a preferable embodiment of the present invention, the mounting block 130 is approximately 2 inches wide by ¾ inch long.

The mounting block 130 includes at least two bore holes 132. The rod 120 passes through one of the bore holes and a fastening means 134 passes through the other bore hole.

The diameter of the borehole can vary, depending on the diameter of the rod and the diameter of the fastener. The first borehole being preferably 5/16 of an inch in diameter, and the second borehole being ⅜ of an inch.

The design of the mounting block allows the user to adjust the length of the rod 120 to just touch the bowstring 60 for an optimal performance. In this way, the distance between the riser and the cushion may be quickly and easily adjusted.

The mounting block is held onto the riser of the bow, where the stabilizer normally goes, by the fastening means 134 such as a bolt and/or set screw.

The mounting block can be attached to the bow in either the front or rear stabilizer holes (if your bow is so equipped).

The block thickness is between 0.2 to 1.5 inches, preferably ¾ inch.

Cushion

Cushion 140 may be formed of flexible thermoplastic elastomeric material, such as—rubber or urethane, or a closed-cell, waterproof foam. It is required that the material of the cushion is resiliently compressible and provides sound deadening characteristics when an object strikes the cushion member.

While it is believed that virtually any material would be effective for cushion 140, the best results have been achieved with a resilient rubber material, which provides a compressible "grip" on the string, or with a closed cell foam material.

In another preferable embodiment, the cushion includes an end cap 148 made of nylon and/or a plastic piece. The end cap is press fitted onto the rod end and then the cushion is affixed by a glue or adhesive to the end cap.

In a least preferable embodiment, the present invention contemplates the use of either a solid or semi-solid material, such as—a gel material.

Cushion 140 may be of cylindrical shaped, preferably a mushroom shaped, but not limited to this shape. The diameter of the cushion is between 0.5 and 2.0 inches, preferably 1.25" inches in diameter.

As best seen in FIG. 3, cushion 140 includes a slot or crossed slot 144 formed in the forward face of the cushion. Slot 144 receives the bowstring 60.

Referring now back to FIG. 1, it can be seen that rod 120 of shock suppressor 10 is connected to the riser 35 by the mounting block 130. To launch an arrow, bowstring 60 is pulled rearwardly to the "drawn" position (not shown).

Cushion 140 is mounted to the end cap, which is affixed to the rod 120 such that the contact surface 146 of cushion 140 is in physical contact with bow string 60 in the "rest" position.

Cushion 140 is oriented with its longitudinal axis generally perpendicular to bowstring 60 in the "rest" position. Once bowstring 60 is drawn rearwardly to the drawn position and released, it will contact the rubber stopper. The material of the cushion serves to suddenly stop the movement of bowstring 60, forcing the arrow to leave the string at its brace height instead of the string traveling forward, past its brace height and then, the arrow being released quicker.

It has been found that the use of a rubber material dampens the vibration movement of the string in several ways. While a small "thud" sound occurs with the use of the shock suppressor of the present invention, the noise is much quieter and lower frequency, and therefore, less likely to startle or alarm game since low frequency sound is less directional.

The design of the shock suppressor, according to the present invention, enables the end user to easily attach or detach the shock suppressor into any archery bow, without the necessity of using tools or the removal of the cables and string.

In order to disassemble the shock suppressor, the fastening means is simply unscrewed from the hole, where the stabilizer is usually mounted.

It should be appreciated by one skilled in the art that the shock suppressor according to the present invention may be used on a re-curve bow or compound bow without varying from the invention.

The invention has been described in an illustrative manner, and it is to be understood that the terminology, which has been used, is intended to be in the nature of words of description rather than of limitation.

What is claimed is:

1. A combination of an archery bow and a shock suppressor mounted on the archery bow, the shock suppressor comprising:

a rigid rod having a first end, a second end, and a length;

a mounting block having at least two bore holes, wherein the first end of the rigid rod passes through one of the bore holes, a fastening means passing through the other bore hole;

wherein the mounting block is mounted to the bow by screwing the fastening means into a hole on a riser of the bow;

wherein the rigid rod is connected to the riser of the bow by the mounting block;

a cushion attached to the second end of the rigid rod;

wherein the length of the rod is adjustable; and wherein the length of the rod is adjusted by sliding the first end of the rod forward or backward through the bore hole.

2. A combination of an archery bow and a shock suppressor mounted on the archery bow, the shock suppressor comprising:

a rigid rod having a first end, a second end, and a length;

a mounting block having at least two bore holes, wherein the first end of the rigid rod passes through one of the bore holes, a fastening means passing through the other bore hole;

wherein the mounting block is mounted to the bow by screwing the fastening means into a hole on a riser on the bow;

wherein the rigid rod is connected to the riser of the bow by the mounting block;

a cushion attached to the second end of the rigid rod;

wherein the rigid rod has an offset bend shape;

wherein the length of the rod is adjustable; and wherein the length of the rod is adjusted by sliding the first end of the rod forward or backward through the bore hole.

3. The combination of claim 2, wherein the rigid rod is made of an aluminum, plastic, steel, titanium, fiberglass, carbon composite, or carbon laminate.

4. The combination of claim 2, wherein the length of the rod is between 5 to 15 inches.

5. The combination of claim 2, wherein the mounting block is made of aluminum, steel, titanium, fiberglass, carbon composite, or carbon laminate.

6. The combination of claim 2, wherein the mounting block has a size of 2 inches wide and ¾ inches long.

7. The combination of claim 2, wherein the cushion is made of rubber, urethane, or closed cell waterproof foam.

8. A compound bow comprising:

a riser having at least one hole, a pair of opposite bow limbs, a first and a second bowstring, which cross one another in extending between opposite bow limbs, a shock suppressor, wherein the shock suppressor comprises:

a rigid rod having a first end, a second end, and a length;

a mounting block having at least two bore holes, wherein the first end of the rigid rod passes through one of the bore holes of the mounting block and wherein the mounting block is positioned in direct contact to the riser of the bow;

wherein a fastening means passes through the other bore hole and is screwed into the hole of the riser;

wherein the length of the rod is adjustable; and a cushion attached to the second end of the rigid rod, the cushion having an outer surface and an inner surface;

wherein the shock suppressor is mounted into the riser below a knocking point;

wherein when the bowstring is drawn to a draw position and released, the outer surface of the cushion physically contacts the bowstring.

9. The compound bow according to claim 8, wherein the cushion further comprises an end cap, wherein the end cap is attached between the cushion and the second end of the rod.

10. The compound bow according to claim 8, wherein the rigid rod is an offset rod.

11. The compound bow according to claim 8, wherein the cushion comprises a slot formed in the forward face of the cushion, wherein the slot receives the bowstring of the compound bow.

12. A combination of an archery bow and a shock suppressor mounted on the archery bow, the shock suppressor comprising:

a rigid rod having a first end, a second end, and a length;

a mounting block having at least two bore holes, wherein the first end of the rigid rod passes through one of the bore holes of the mounting block and wherein the mounting block is positioned in direct contact to a riser of the bow, wherein a fastening means passes through the other bore hole and into the bow riser;

wherein the length of the rod is adjustable; and a cushion attached to the second end of the rigid rod, the cushion having a forward face and a backward face;

wherein the cushion comprises a slot formed in the forward face of the cushion, wherein the slot receives the bowstring of the archery bow.

* * * * *